US005760798A

United States Patent [19]

Suzuki et al.

[11] Patent Number: 5,760,798

[45] Date of Patent: Jun. 2, 1998

[54] INK JET RECORDING APPARATUS AND METHOD IN WHICH AN AMOUNT OF INK EJECTED IS CORRECTED ACCORDING TO A RECORDING HEAD STATE

[75] Inventors: Akio Suzuki, Yokohama; Nobuhiko Ogata, Tokyo, both of Japan

[73] Assignee: Canon Kabushiki Kaisha, Tokyo, Japan

[21] Appl. No.: 308,537

[22] Filed: Sep. 21, 1994

[30] Foreign Application Priority Data

Sep. 24, 1993 [JP] Japan ..... 5-238021

[51] Int. Cl.[6] ..... B41J 29/38

[52] U.S. Cl. ..... 347/14; 347/12; 347/56; 358/518; 358/302

[58] Field of Search ..... 347/14, 12, 184, 347/56, 9, 10, 57, 65, 94, 42, 3, 60, 66, 47; 358/518, 302

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/56 |
| 4,463,359 | 7/1984 | Ayata et al. | 347/56 |
| 4,558,333 | 12/1985 | Sugitani et al. | 347/65 |
| 4,608,577 | 8/1986 | Hori | 347/43 R |
| 4,723,129 | 2/1988 | Endo et al. | 347/56 |
| 4,740,796 | 4/1988 | Endo et al. | 347/56 |
| 4,829,323 | 5/1989 | Suzuki et al. | 347/15 |
| 4,851,923 | 7/1989 | Abe et al. | 358/296 |
| 4,853,768 | 8/1989 | Suzuki et al. | 358/517 |
| 4,882,621 | 11/1989 | Suzuki et al. | 358/518 |
| 5,132,702 | 7/1992 | Shiozaki et al. | 347/12 |
| 5,160,941 | 11/1992 | Fujiwara et al. | 347/184 |
| 5,172,130 | 12/1992 | Takahashi | 347/14 |
| 5,172,223 | 12/1992 | Suzuki et al. | 358/529 |
| 5,225,849 | 7/1993 | Suzuki et al. | 347/14 |
| 5,331,340 | 7/1994 | Sukigara | 347/14 |
| 5,343,231 | 8/1994 | Suzuki | 347/14 |
| 5,353,052 | 10/1994 | Suzuki et al. | 347/19 |
| 5,444,468 | 8/1995 | Fukushima et al. | 347/14 |

FOREIGN PATENT DOCUMENTS

| | | |
|---|---|---|
| 0390473 | 10/1990 | European Pat. Off. . |
| 0396855 | 11/1990 | European Pat. Off. . |
| 0517543 | 12/1992 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |
| 2-25338 | 1/1990 | Japan . |
| 2-3326 | 1/1990 | Japan . |
| 2-219659 | 3/1990 | Japan . |
| 2-265749 | 10/1990 | Japan . |

*Primary Examiner*—Benjamin R. Fuller
*Assistant Examiner*—Raquel Yvette Gordon
*Attorney, Agent, or Firm*—Fitzpatrick, Cella, Harper & Scinto

[57] ABSTRACT

When a recording head having an arrangement of plural ejection portions for ejecting ink is moved for scanning, coefficients for the calculation of blur correction are set according to the number of nozzles used during scanning (magnification), and image signals corresponding to nozzles at scanning boundaries are corrected by an amount selected according to the set coefficients. This method makes it possible to always obtain a good image in which stripes formed at such boundaries are reduced even if image recording conditions are changed.

33 Claims, 10 Drawing Sheets

INK JET RECORDING APPARATUS AND METHOD IN WHICH AN AMOUNT OF INK EJECTED IS CORRECTED ACCORDING TO A RECORDING HEAD STATE

BACKGROUND OF THE INVENTION

1. Field of the Invention

This invention relates to an ink jet recording apparatus and a recording method and, more particularly, to an ink jet recording apparatus and a recording method for performing recording by serial scanning.

2. Description of the Related Art

Ink jet recording apparatuses arranged to record images by ejecting ink onto recording members are known. Recently, such ink jet recording apparatuses have been developed rapidly and have come into wide use because they can easily be employed to perform multi-color recording, can easily be reduced in size and have other advantages. In such ink jet recording apparatuses, ink blurs on a recording medium greatly influence image quality.

In a serial scan type ink jet recording apparatus, as shown in FIGS. 3(*a*) and 3(*b*), a scanning travel of a recording head 9 in a direction of arrow A (in a main scanning direction) for image recording of a width d is repeated in the order of areas (1), (2), and (3). The width d is determined by the number of nozzles and the recording density of the head; it is 16.256 mm if the recording apparatus has 256 nozzles and a recording density of 400 dots/inch.

If the amount of ink applied for recording is small, the extent of blurring is small and the recorded image width, i.e., the width of a recorded image portion formed by one scanning travel of the head, is substantially equal to the recording width d. In such a situation, at most only minor image defects occur at junctures between recorded image portions, which correspond to cycles of scanning in which the head is moved in the direction of arrow B (in a sub scanning direction) and is thereafter moved in the direction of arrow A.

However, in a high-density image portion, i.e., an image portion having a large amount of ink, an ink blur occurs such that the recorded image width is d+Δd. If the scanning width in the direction B is d, then image portions overlap each other by Δd to form a black stripe (banding). Conversely, if the scanning width is previously set to d+Δd, a white stripe is formed in a low-density image portion where the amount of ejected ink is large.

In view of this problem, the inventors of the present invention have proposed image recording apparatuses in which when a value of an image signal corresponding to a serial scanning boundary is larger, it is corrected by being reduced to prevent formation of a black stripe, as described in the specifications of U.S. Pat. No. 5,225,849 (Japanese Patent Laid-Open Publication Nos. 2-3326 and 2-25338) Japanese Patent Laid-Open Publication Nos. 2-219659 and 2-26574.

The principle of this operation will be described below. First, a signal corresponding to a scanning boundary is detected to determine the amount of ink to be printed at the boundary. If the amount of ink to be printed at the boundary is small, no stripe will occur due to blurring. In such a situation, the signal corresponding to the boundary is not specially processed. If the amount of ink at the boundary is large, the signal for printing at the boundary is reduced to limit the extent of blurring, thereby preventing formation of a black stripe. The rate of reduction in the signal corresponding to the boundary is determined according to the amount of ink printed at the boundary.

In a serial scan type of recording apparatus, the number of nozzles (ejection portions such as ejection outlets) used during one scan may be changed. Reduction copying will be described as an example of such a case. For example, in the case of making a reduced copy which has been decreased in size by a magnification of 70% by using the above-mentioned recording apparatus, the basic operation may be such that image data corresponding to 256 nozzles is thinned out so that the amount of data is reduced to 70%, and ink is ejected through 179 nozzles for printing. If the one-scan reading width of a reader unit is fixed in correspondence with 256 pixels, the one-scan printing width corresponds to 179 nozzles. If an image is recorded at a density of 400 dots/inch, the sub scanning width in the direction of arrow f shown in FIG. 2 is about 11.367 mm.

Generally, it is undesirable to change the extent of sub scanning according to the magnification, because the extent of sub scanning is greatly affected by any eccentricity in the transport roller and other factors. Therefore, a sub scanning method has been practiced frequently in which when the magnification is in the range of 50 to 99%, upper half 128 nozzles of a printing head are used during one printing scan, the next scan is made by using lower half 128 nozzles without making a sub scan, and a sub scan through a distance of 16.256 mm corresponding to 256 nozzles is made subsequently. In this case, when the magnification is in the range of 25 to 49%, 64 nozzles are used during each main scan and a sub scan by 16.256 mm is made every four main scans.

If the state of a recording head is varied, for example, if a head is used in different manners as described above, a stripe defect occurs at scanning boundaries unless the image signal at each boundary (also referred to as "end") is processed in a different manner according to the manner of using the head.

This is for the reason described below.

There are various methods for ejecting ink from a head. A method of forming a nozzle with a piezoelectric element which ejects ink by a pressure caused by deforming the piezoelectric element is known. Another method is known in which an electrothermal transducer element in a nozzle is heated to boil ink so that ink is ejected because of the pressure caused by boiling. As ink ejection is repeated, the piezoelectric element is energized or electrothermal transducer element is heated to cause an increase in the temperature of ink. The amount of heat developed in the case of printing using only 128 or 64 nozzles for one scan is different from (smaller than) the amount of heat developed in the case of printing using 256 nozzles. The temperature of ink is correspondingly varied (reduced). Also, since ink in unused nozzles is not heated, the temperature of ink at the boundary between unused and used nozzles is lower than the temperature at a center of the used nozzles. With a variation in ink temperature, the viscosity of ink is varied, resulting in a variation in the amount of ejected ink.

If the amount of ejected ink is varied, the extent of blurring on a recording member is varied to cause a change in the formation of a stripe at the boundary. For example, if boundary signal processing is performed based on the assumption that all 256 nozzles are used, the amount of ejected ink is reduced due to a reduction in ink temperature in the case where only 128 nozzles are used at a time so that a white stripe is formed at the boundary.

The ink temperature is also variable to form a stripe depending upon printing modes of the recording head. For example, printing using image data having a high printing duty ratio tends to cause a larger increase in ink temperature in comparison with character data printing, and will therefore cause a black stripe easily. A black stripe is also formed easily, if the ink temperature is controlled to be maintained at a higher temperature in order to increase the amount of ejected ink.

These problems are particularly serious in the case of a system in which ink is boiled by heating an electrothermal transducer element to eject ink.

SUMMARY OF THE INVENTION

An object of the present invention is to provide an ink jet recording apparatus and a recording method which make it possible to obtain a good image in which occurrence of stripes (banding) is limited.

Another object of the present invention is to provide an ink jet recording apparatus and a recording method which can prevent the occurrence of stripes at scanning boundaries even if the state of a recording head is varied, particularly, even if the head is used in different manners.

To achieve these objects, according to one aspect of the present invention, there is provided an ink jet recording apparatus for recording by using a recording head having plural ejection portions arranged in an arrangement direction for ejecting an ink, this recording head being repeatedly scanned in a direction different from the arrangement direction of the ejection portions to make plural scans for recording an image portion of an image. This apparatus includes correction means for correcting an amount of the ink which is ejected onto at least one boundary of the image portion recorded in each scan, and control means for controlling an mount of correction made by the correction means in accordance with a state of the recording head during each scan.

According to another aspect of the present invention, there is provided an ink jet recording method for recording using a recording head having plural ejection portions arranged in an arrangement direction for ejecting an ink, the recording head being repeatedly scanning in a direction different from the arrangement direction of the ejection portions to make plural scans for recording an image portion of an image. The method involves setting a recording mode according to a state of the recording head during each scan, and correcting an amount of ink which is ejected onto at least one boundary of the image portion recorded in each scan by an amount according to the recording mode that has been set.

Thus, it will be appreciated that this invention concerns a serial-type recording apparatus which adjusts the amount of ink being applied to a portion of an image being recorded in serial fashion in order to avoid the unwanted production of either dark or light stripes between image portions recorded in adjacent scans. Such adjustment can be performed, for example, according to the recording mode being used, or the temperature of the ink in the recording head.

By using the thus-arranged apparatus and method, signals corresponding to the ejection portions at scanning boundaries can be corrected by an amount according to the state of the recording head during each scan. It is therefore possible to obtain an image in which joint marks at scanning boundaries are reduced no matter what is the state of the recording head.

DESCRIPTION OF THE PREFERRED EMBODIMENTS

Preferred embodiments of the present invention will be described with reference to the accompanying drawings.

(Embodiment 1)

Figure 1:
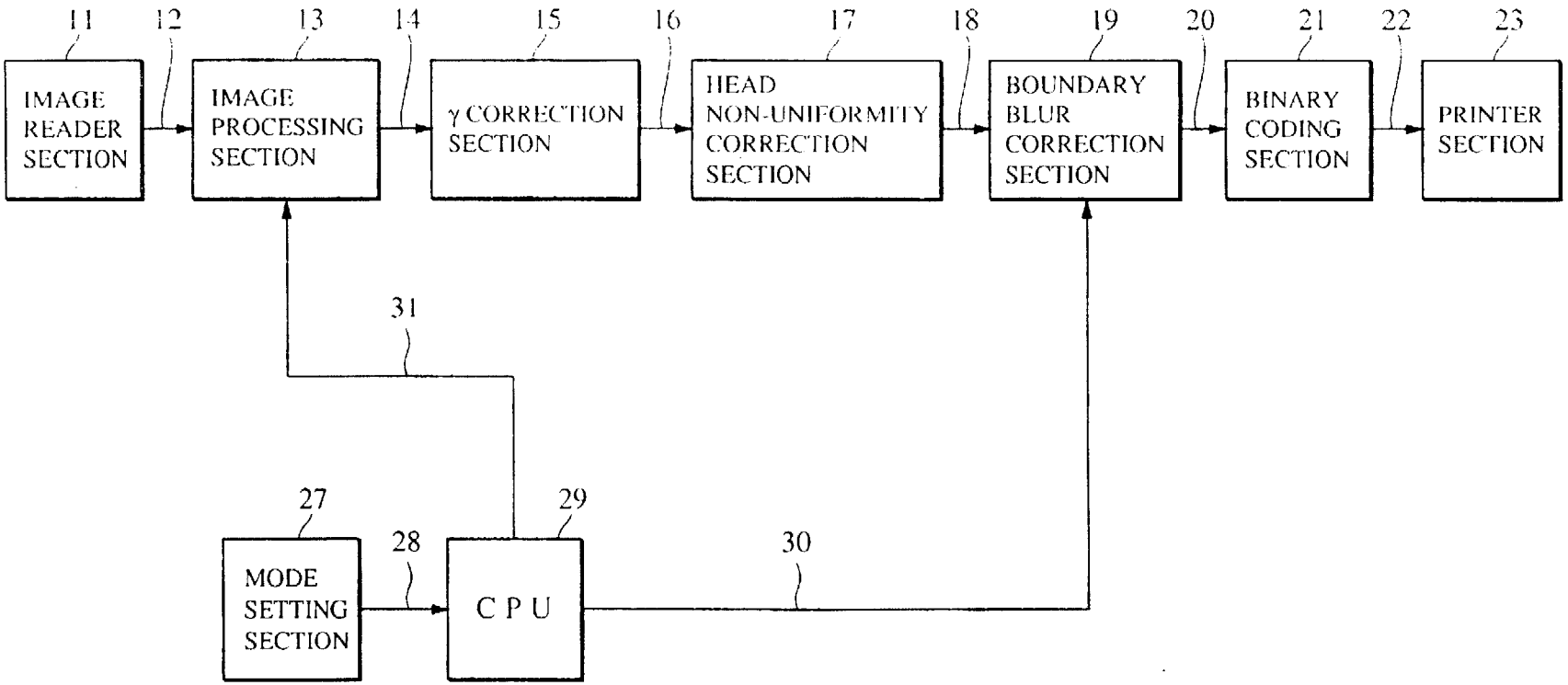
FIG. 1 is a block diagram of embodiments of the present invention.

FIG. 1 is a block diagram of a first embodiment of the present invention. FIG. 1 depicts an image reader section for reading an original image, red (R), green (G) and blue (B) read signals 12, an image processing section 13 in which processing for logarithmic conversion, black extraction, under color removal, masking and the like is performed (this can be done using known procedures), color signals, i.e., cyan (C), magenta (M), yellow (Y) and black (Bk) signals 14 obtained after image processing, a gamma correction section 15 for effecting gradation correction, again in a known manner, signals 16 after gradation correction, a head non-uniformity correction section 17 for correcting a density non-uniformity of a printing head in a known fashion, image signals 18 following non-uniformity correction, a boundary blur correction section 19, image signals 20 following boundary blur correction, a binary processing section, image signals 22 following binary coding, a printer section 23, a mode setting section 27, a mode setting signal 28, a CPU 29, and a boundary blur correction control signal 30.

Figure 2:
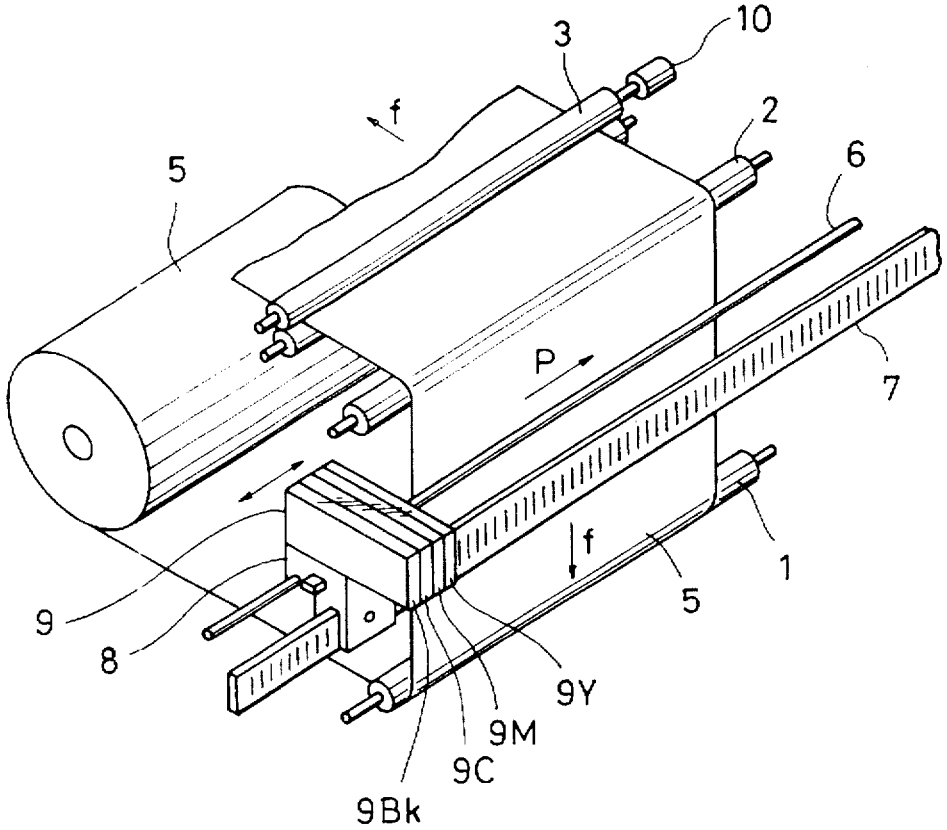
FIG. 2 is a schematic perspective view of a printer used in accordance with the embodiments of the invention.
Figure 3A:
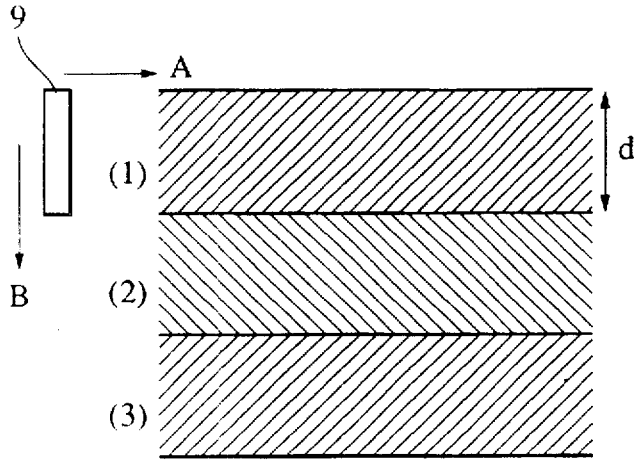
FIG. 3(a) PRIOR ART
FIGS. 3(*a*) and 3(*b*) are diagrams for explaining a blur at a boundary.
Figure 3B:
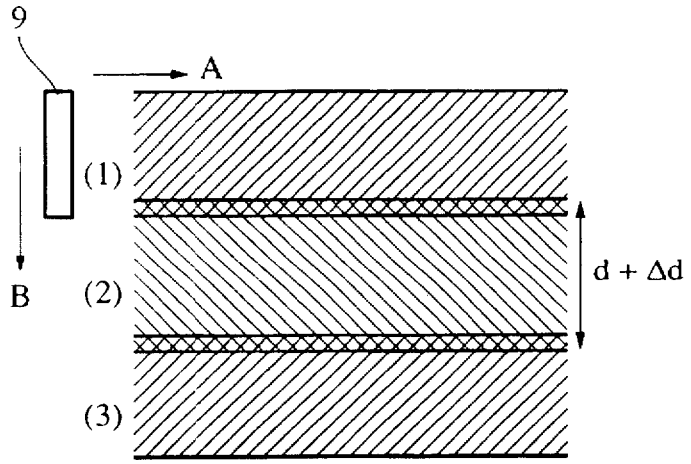
FIG. 3(b) PRIOR ART

FIG. 2 is a schematic perspective view of a recording apparatus having the configuration shown in FIG. 1. As shown in FIG. 2, a recording member 5 in the form of a rolled lengthwise sheet is pinched between feed rollers 3 after being led via transport rollers 1 and 2 and is fed in the direction of arrow f as the feed rollers 3 are driven by a sub scanning motor 10 connected to one of the feed rollers 3. Guide rails 6 and 7 are disposed parallel to the recording member so as to extend across the feed path of the recording member. A recording head unit 9 mounted on a carriage 8 is moved reciprocatingly and horizontally along the guide rails 6 and 7. Heads 9Y, 9M, 9C, and 9Bk for printing in four colors yellow, magenta, cyan and black, constituting the head unit 9, are mounted on the carriage 8, and tanks containing inks of four colors are combined with these heads. The recording member 5 is intermittently fed through a distance corresponding to a printing width of the heads 9 at a time. When the recording member 5 is stopped, the heads are moved in the direction of arrow P for scanning (main scanning) to eject droplets of ink in accordance with image signals. Each head has 256 nozzles and a recording density of 400 dots/inch (dpi). The printing width of each head in the direction f is 16.256 mm. The printing width in the direction P is 594 mm.

Figure 5:
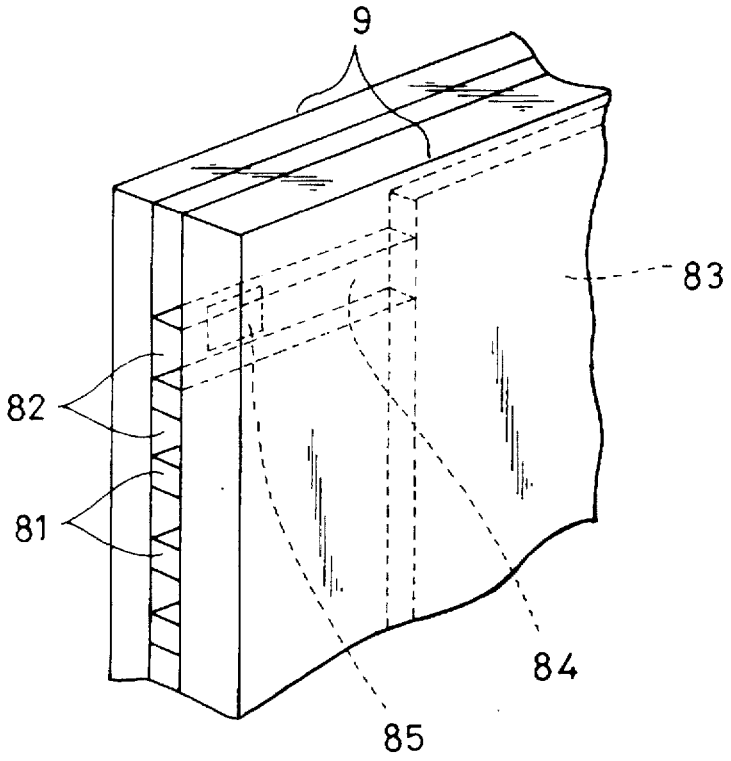
FIG. 5 is a schematic partial perspective view of a printing head used in accordance with the embodiments of the invention.

FIG. 5 is a perspective view of a portion of each recording head 9 in the printer section 23, schematically showing the structure of ink outlets. An outlet surface 81 faces the recording member 5 with a predetermined gap formed therebetween. A plurality of outlet openings 82 are formed with a predetermined pitch in the outlet surface 81. An electrothermal transducer element 85 for generating energy for ejecting ink is provided on a wall surface of each of liquid passages 84 which provide communication between a common liquid chamber 83 and the outlets 82. In this embodiment, the recording heads 9 are mounted so that the outlets 82 are arranged in a direction perpendicular to the main scanning direction of the carriage 8. When an image signal or ejection signal is supplied, the corresponding one (or more) of the electrothermal transducer element 85 is driven on the basis of the signal to cause film boiling of ink in the liquid passage 84. Ink is ejected through the outlet 82 by the pressure generated when film boiling occurs.

Referring back to FIG. 1, the image reader section 1 reads an original image and sends signals 12 of three colors R, G and B to the image processing section 13. The image processing section 13 processes these signals by the above-mentioned image processing and outputs image signals 16 of colors C, M, Y, and Bk. The head non-uniformity correction section 17 corrects these signals so that a characteristic non-uniformity of each head is canceled out. For example, a value of an image signal for printing through a nozzle having a higher ink ejection rate is reduced, while a value of an image signal for printing through a nozzle having a lower ink ejection rate is increased. Signals 18 are obtained by this non-uniformity correction. The boundary blur correction section 19 processes signals 18 by blur correction processing described below in detail.

Signals 20 after the blur correction are sent to the binary coding processing section 21 to be converted into binary data by a dither method, an error diffusion method or the like. Image signals 22 after this binary coding are sent to the printer section 23 to record the read image.

Blur correction processing of the boundary blur correction section 19 now will be described.

First, image signals for printing corresponding to scanning boundaries are obtained by calculation. That is, if color signals for printing through boundary nozzles are represented by Ce, Me, Ye, and Bke, $$T=a\cdot Ce+b\cdot Me+c\cdot Ye+d\cdot Bke$$

is calculated. The boundary nozzles correspond to the first and 256th nozzles, if the number of nozzles used for one scan is 256. If the number of nozzles used is 128, the boundary nozzles correspond to the first and 128th nozzles with respect to odd-number scans and correspond to the 129th and 256th nozzles with respect to even-number scans. If the number of nozzles used is 164, the boundary nozzles correspond to the first and 64th nozzles with respect to the first scan, the 65th and 128th nozzles with respect to the second scan, the 129th and 192nd nozzles with respect to the third scan, and the 193rd and 256th nozzles with respect to the fourth scan. The nozzles selected for the calculation are not necessarily limited to these, and the nozzle range considered to influence the formation of stripes at boundaries may be experimentally determined. In this embodiment, signals for two top boundary nozzles and two bottom boundary nozzles are used for the calculation. Constants a to d are weighting coefficients, which are also determined experimentally.

The following are examples of these values in normal recording of this embodiment.

Each of Ce, Me, Ye, and Bke has a value ranging from 0 to 255, and $$a=b=c=d=1.0.$$

Accordingly, T ranges from 0 to 1020.

Figure 4:
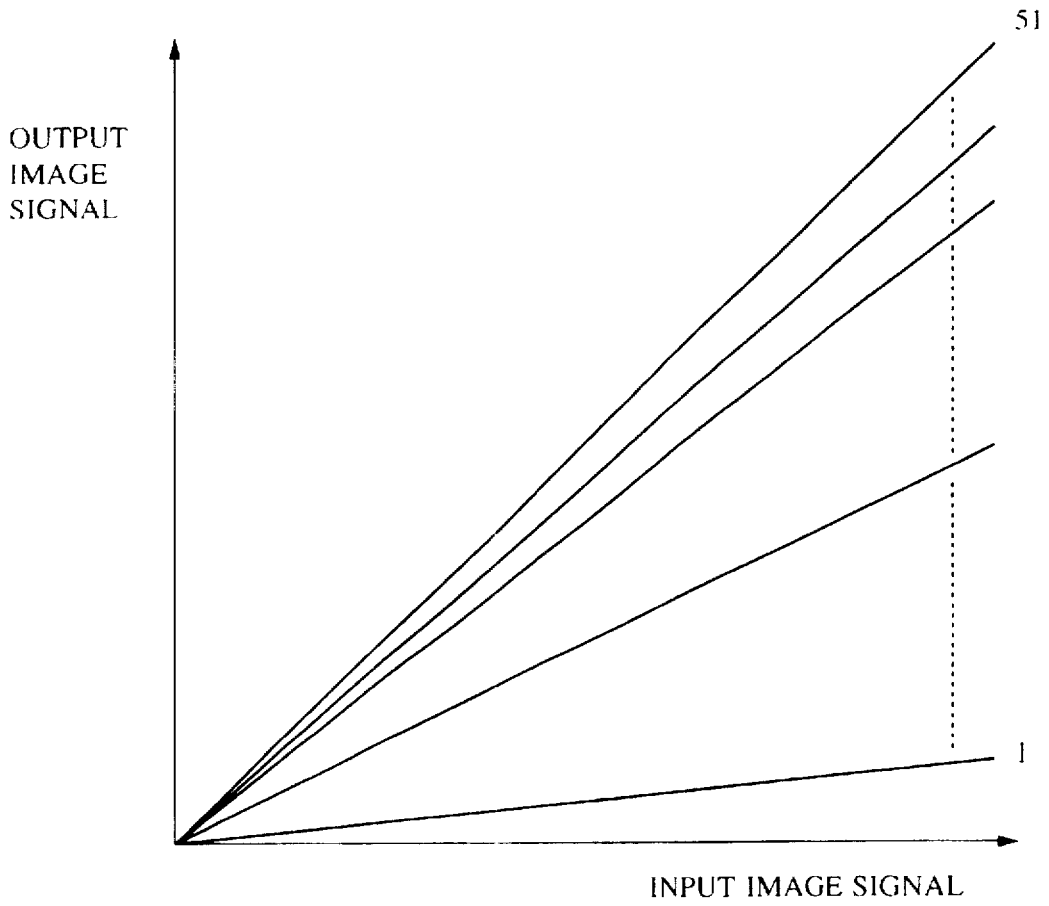
FIG. 4 is a diagram representing a table for correcting a boundary image signal.

The image signals for printing at each boundary are corrected by a table such as that shown in FIG. 4. In the table shown in FIG. 4, fifty one straight lines having inclinations of 0 to 1.0 are provided, and these are regularly spaced from each other. One of these straight lines is selected according to the value of T. For example, if the value of T is T0 or smaller, the signals are output in accordance with the straight line having an inclination of 1.0 without being corrected. If T0 is exceeded, the inclination is reduced according to the value of T, that is, the amount of correction is increased so that the density of the image signals becomes lower. The correspondence relationship between the value of T and the straight lines is previously stored in a read only memory (ROM).

This embodiment will be described in more detail. Those skilled in the art, in view of this disclosure, will appreciate the following aspects of this invention can be practiced by suitably modifying a recording apparatus so that it can perform the various operations related to blur correction.

Figure 6:
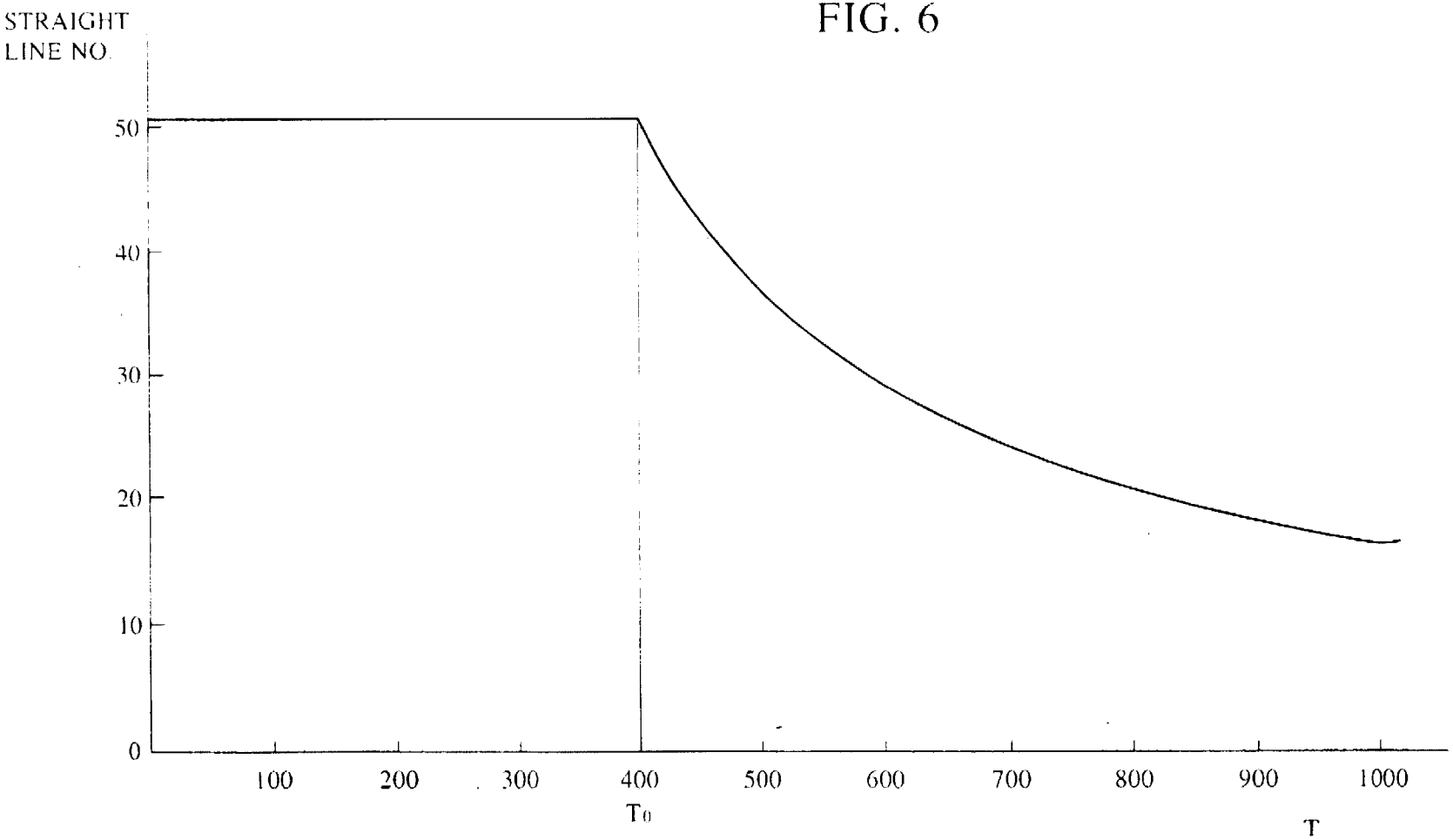
FIG. 6 is a diagram of the correspondence relationship between T and the correction table in the first embodiment of the invention.

Referring to FIG. 4, numbers 1, 2, 3 are assigned to the straight lines having inclinations of 0, 0.2 and 0.4, respectively, and the 1.0 inclination straight line has a number 51. The relationship between the value of T and the selected straight line numbers is determined as shown in FIG. 6. That is, T0 is set to 400 and no correction is made when the value of T is equal to or smaller than 400. When value of T is larger than 400, the straight line of a smaller inclination is selected to increase the amount of correction (reduction in density). This relationship is set in a read only memory or a random access memory (RAM) having the value of T as an address input and the straight lines numbers as output data. The table of FIG. 4 is set in another ROM or RAM capable of selecting the inclination by an output from the T value-straight line number ROM or RAM. Image signals corresponding to boundary nozzles are corrected by inputting their values to the table.

The nozzles selected as boundary nozzles for which signal correction is made may be the same as those selected for calculating T, but it is not always necessary to select these nozzles in a one-to-one relationship. For example, when the magnification is 100%, four nozzles, i.e., the first, second, 255th and 256th nozzles may be selected to calculate T, while the signals to only two nozzles, i.e., the first and 256th nozzles are corrected.

This embodiment will be described with respect to its features. The mode setting section 27 is an operating section through which a user sets recording conditions, e.g., a copy magnification, a recording sheet size and an original sheet size. Setting signal 28 is sent to the CPU 29 and correction control signal according to a set recording mode is sent to the blur correction section 19. The blur correction section 19 resets weighting coefficients according to correction control signal 30.

In this embodiment, the weighting coefficients are changed according to the copy magnification. It is assumed here that weighting coefficients set when the magnification is 100% or greater and when all the 256 nozzles are used for one scan are a1, b1, c1, and d1, weighting coefficients set when the magnification is 50 to 99% and when the number of nozzles used for one scan is 128 are a2, b2, c2, and d2, and weighting coefficients set when the magnification is 25 to 49% and when the number of nozzles used for one scan is 64 are a3, b3, c3, and d3. Then, in this embodiment, a1=b1=c1=d1=1.0, a2=b2=c2=d2=0.8, and a3=b3=c3=d3=0.6.

That is, the weighting coefficients are selected so as to satisfy a1, b1, c1, d1>a2, b2, c2, and d2>a3, b3, c3, d3.

Thus, in this embodiment, the value of T is increased to set a larger amount of correction of image signals corresponding to scanning boundaries, if the number of nozzles used is larger, that is, the amount of heat developed is larger.

Figure 7:
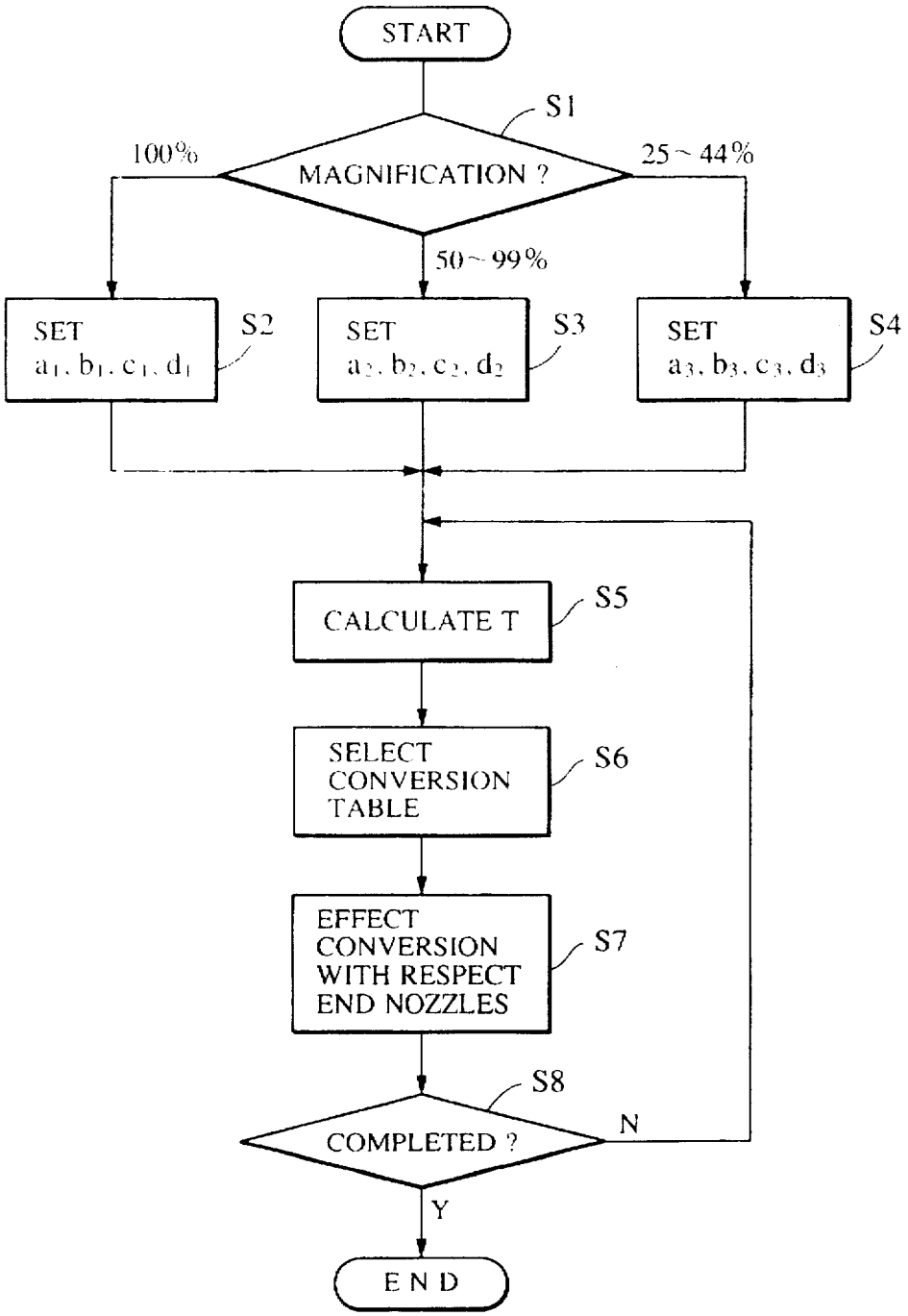
FIG. 7 is a flowchart showing the operation of the first embodiment.

The operation of this embodiment will be described with reference to the flow chart shown in FIG. 7, and to FIG. 1. In Step 1, the CPU 29 sends to the boundary blur correction section 19 blur correction control signal 30 according to setting signal (copy magnification) 28 from the mode setting section 27. In Steps 2 to 4, the boundary blur correction section 19 sets weighting coefficients, a1 to d1, a2 to d2, and a3 to d3 according to blur correction control signal 30. In Step 5, the blur correction section 19 calculates T on the basis of the set weighting coefficients and boundary color signals, as described above. In Step 6, the conversion table of FIG. 4 (straight line number) is selected in correspondence with the value of T in FIG. 6. In Step 7, color signals to the end nozzles are converted in accordance with the conversion table of FIG. 4 selected in Step 6. The conversion processing is repeated until recording of one page is completed in Step 8.

In this embodiment, weighting coefficient values may be previously obtained by experiment with respect to the different modes, and may be variously set. For example, in this embodiment, only the value d may be controlled by considering the fact that the amount of Bk ink, among the amounts of other inks, is a dominant factor with respect to a high-density area image. That is, a satisfactory effect was obtained by setting a1=b1=c1=d1=1.0, a2=b2=c2=1.0, d2=0.6 a3=b3=c3=1.0, d3=0.4.

In such a case, the control operation can be simplified and the time or labor required to experimentally obtain weighting coefficients can be reduced.

By controlling the amount of correction according to the magnification in the above-described manner, stripes at scanning boundaries in the resulting image can be reduced or de-emphasized, even if the ink temperature is varied due to a change in the number of nozzles used for one scan.

(Embodiment 2)

A second embodiment of the present invention will now be described. In the second embodiment, the blur correction amount is changed when the mode of using the head is changed during image recording.

To copy an A4-size image at a magnification of 100%, all the 256 nozzles are used for the ordinary scan. However, since the length of the A4 size (297 mm) is not an integer multiple of one scanning width of 16.256 mm, it is necessary to perform length adjustment with respect to one scan. The printing width of the scan for which length adjustment is performed is 297−16.256×18=4.392 mm, and the number of nozzles used for this scan is 69. This embodiment exemplifies a control of the blur correction amount for such a scan.

The block configuration of this embodiment is the same as that shown in FIG. 1. However, weighting coefficients are changed when the scan for which length adjustment is to be performed is made. The CPU calculates the number of nozzles used for the length adjustment scan from a magnification, a recording sheet size and an original size set in the mode setting section, and controls weighting coefficients at the time of length adjustment scan according to the result of this calculation. As in Embodiment 1, the coefficients are increased to set a larger amount of correction, if the number of nozzles used is large.

Figure 8:
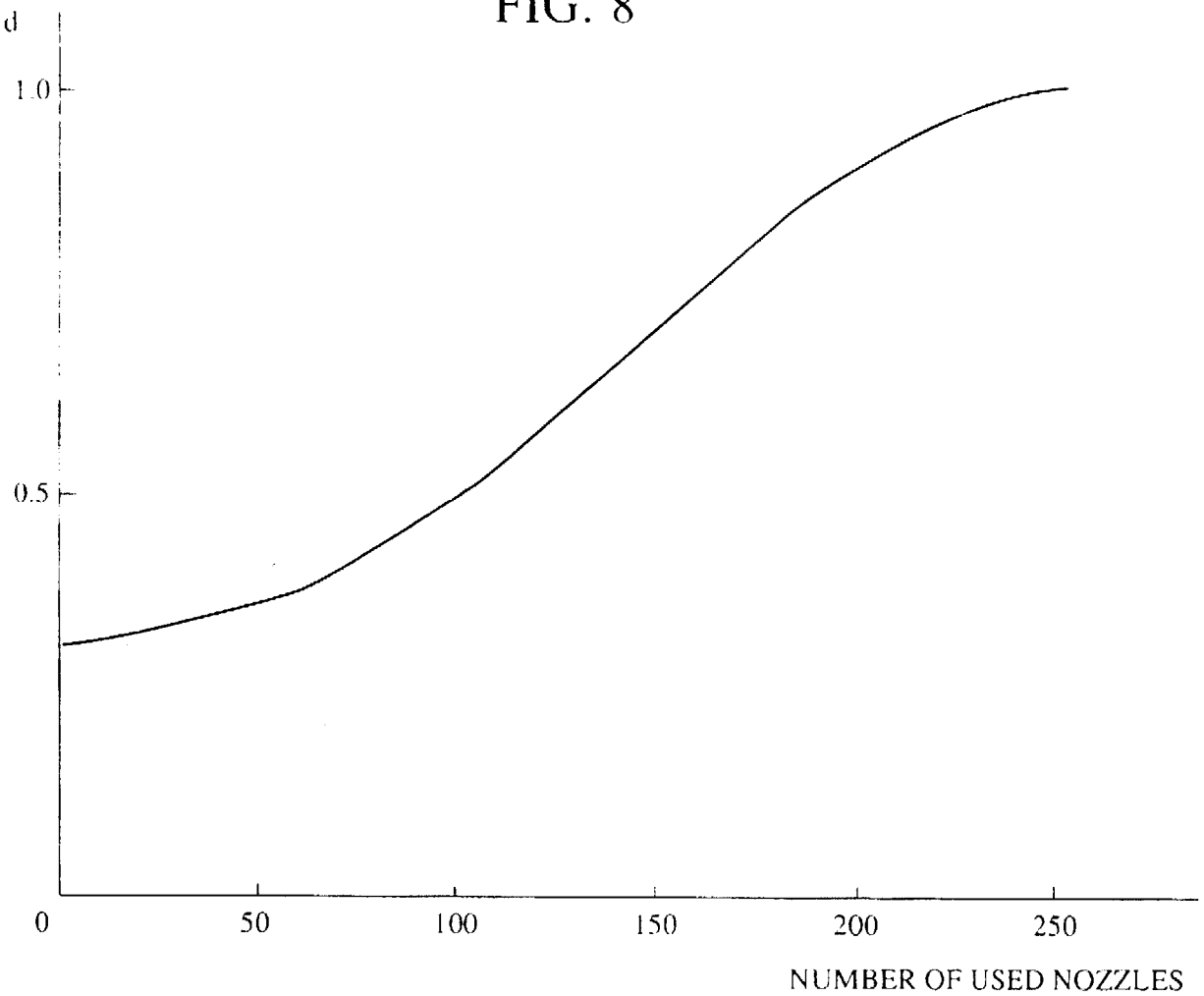
FIG. 8 is a diagram of a coefficient in the second embodiment of the invention.

The same recording apparatus as that of Embodiment 1 was used for this embodiment and only the coefficient d for Bk was controlled in accordance with the relationship between the number of nozzles and the value d shown in FIG. 8 while the coefficients a, b, and c were fixed at 1.0, thereby achieving a good result. This relationship was obtained experimentally. However, the values a, b, and c may be controlled simultaneously and other various combinations of the controlled values are possible.

As described above, stripes at scanning boundaries can be reduced or de-emphasized, even if the temperature of the head (ink temperature) is varied during recording of one image.

(Embodiment 3)

A third embodiment of the present invention will be described below.

In Embodiments 1 and 2, weighting coefficients are controlled as means for controlling the amount of blur correction. In this embodiment, the amount of correction is controlled by changing the correspondence relationship between the correction table and T. The block configuration of this embodiment is the same as that shown in FIG. 1, but a plurality of correspondence relationships between the calculation result T and the correction table are prepared and the blur correction section 19 controls blur correction by selecting the correspondence relationship according to blur correction signal 30.

Figure 9:
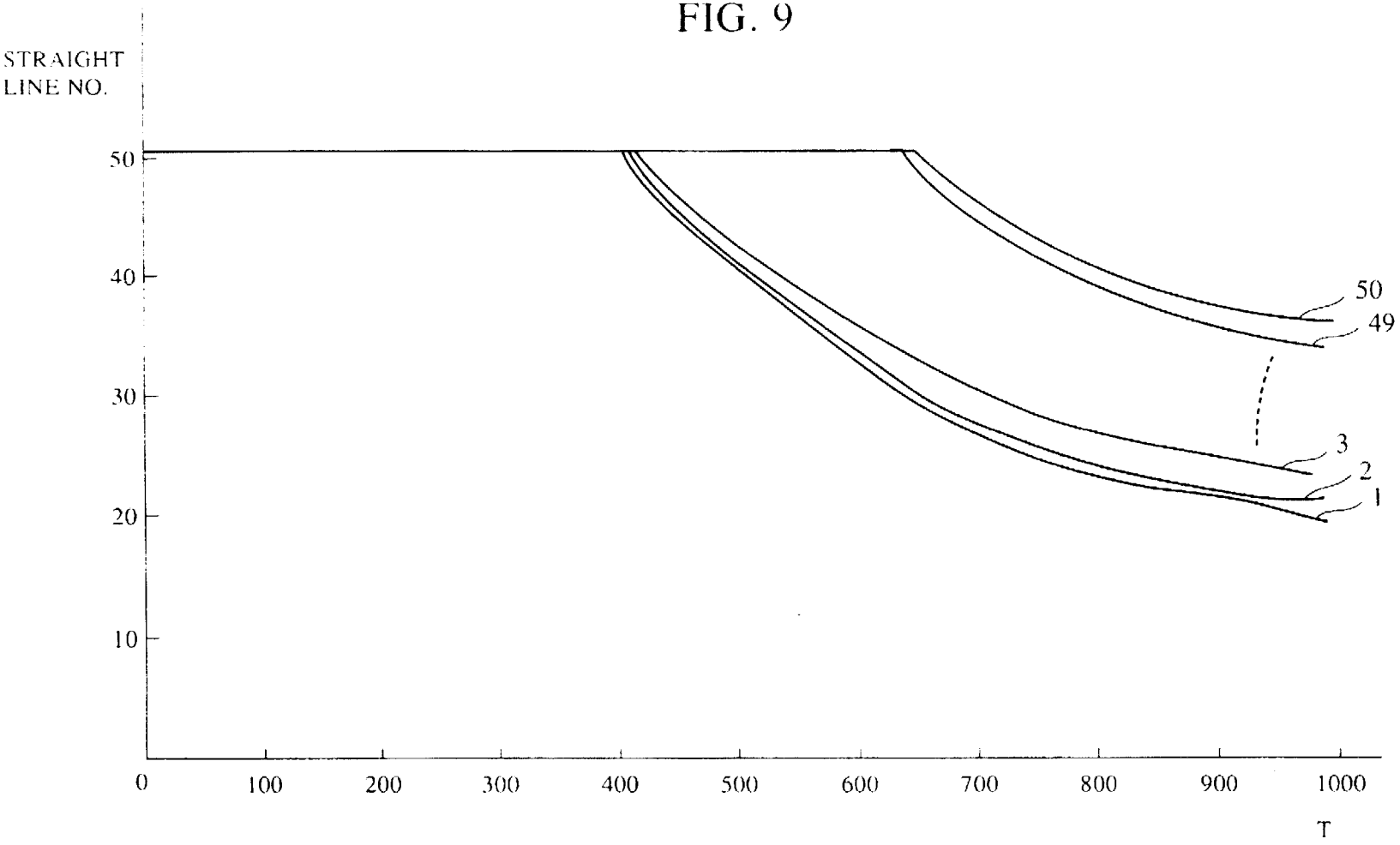
FIG. 9 is a diagram of the correspondence relationship between T and a correction table in the third embodiment of the invention.
Figure 10A:
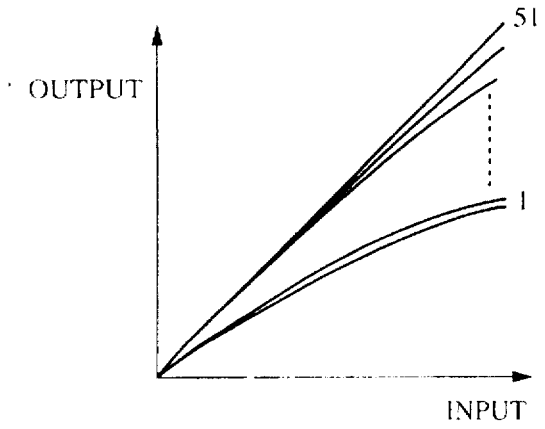
FIGS. 10(*a*) through 10(*d*) are diagrams representing other boundary image signal correction tables.
Figure 10B:
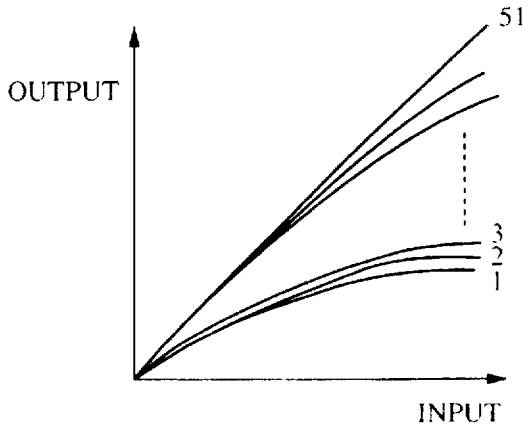
Figure 10C:
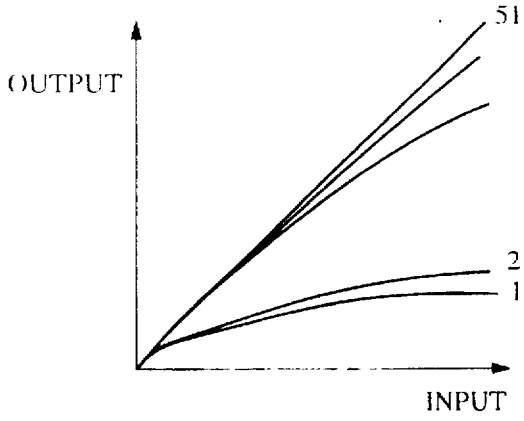
Figure 10D:
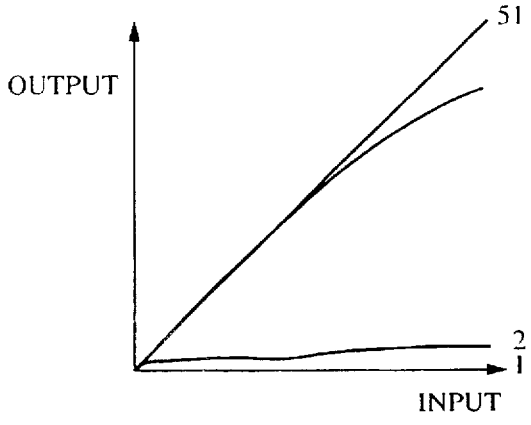

FIG. 9 shows examples of such correspondence relationships between T and the correction table used in this case. One of them is selected according to the used state of the head. When the number of used nozzles is large, the ejection volume is so large that blurs at scanning boundaries are noticeable. In such a situation, a relationship characterized by a smaller value of T0 and a larger amount of correction is selected. In the case of FIG. 9, the T0 value of the correspondence relationship 1 is smaller than that of the correspondence relationship 50 and therefore determines a larger amount of correction of reducing the ejection volume.

The correction table curves of FIG. 4 may be changed as well as the correspondence relationships between T and the correction table.

FIG. 10 shows examples of correction curves used in such a case. Curves of a lower correction rate (a) to a higher correction rate (d) are prepared with respect to the same curve number to be selected. The amount of correction is controlled in such a manner that the table (d) is selected when the number of used nozzles is large, and the table of a lower correction rate is selected in the order of (c), (b) and (a), as the number of nozzles is reduced. Also, the correction curves are formed non-linearly so that the output is limited as the input signal is increased.

Thus, the table configuration can be determined by freely forming such curves, thereby increasing the degree of correction freedom.

The correction algorithm is not limited to those described above with respect to the embodiments. Also, the recording apparatus configuration and the head structure are not limited to those described above. Essentially, any other arrangements or methods are possible as long as the amount of blur correction can be controlled when the state of the recording head during scanning is changed, for example, when the number of nozzles used for one scan is changed or when the ink temperature is varied in an ink jet recording apparatus arranged to correct blurs at scanning boundaries.

The present invention is particularly suitable for use in an ink jet recording head and recording apparatus wherein thermal energy generated by an electrothermal transducer, a laser beam or the like is used to cause a change of state of the ink in order to eject or discharge the ink. This is because a high density of the picture elements and high resolution recording are possible.

The typical structure and the operational principle of such devices are preferably those disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from the nucleate boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejection portion. This is because the present invention is effective to perform the recording operation with certainty and at high efficiency regardless of the type of recording head.

In addition, the present invention is applicable to a serial type recording head wherein the recording head is fixed on the main assembly, to a replaceable chip type recording head which is connected electrically with the main apparatus and which can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. Examples of such means include a capping means for the recording head, cleaning means therefore, pressing or sucking means, preliminary heating means which may be the electrothermal transducer, an additional heating element or a combination thereof. Also, means for effecting preliminary ejection (not for the recording operation) can stabilize the recording operation.

As regards the type of recording head which can be mounted, it may be a single head corresponding to a single color ink, or may be plural heads corresponding to the plurality of ink materials having different recording colors or densities. The present invention is effectively applied to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiments, the ink has been liquid. It also may be ink material which is solid below the room temperature but which becomes liquid at room temperature. Since the ink is kept within a temperature between 30° C. and 70° C., in order to stabilize the viscosity of the ink to provide the stabilized ejection in the usual recording apparatus of this type, the ink may be such that it is liquid within the temperature range when the recording signal of the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, in response to the application of the recording signal producing thermal energy, the ink is liquefied, and the liquefied ink may be ejected. Another ink material may start to be solidified at the time when it reaches the recording material.

The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is oriented so as to face the electrothermal transducers. The most effective of the techniques described above is the film boiling system.

The ink jet recording apparatus may be used as an output terminal of an information processing apparatus such as a computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

As described above, in ink jet recording using a plurality of ejection outlets, the amount of correction of blurs at scanning boundaries is controlled according to the state of the recording head, for example, according to the number of nozzles used and the ink temperature, so as to always obtain a good image in which stripes at the boundaries are reduced even if image recording conditions are changed.

What is claimed is:

1. An ink jet recording apparatus for recording by using a recording head having a plurality of ejection portions arranged in an arrangement direction for ejecting an ink, said recording head being repeatedly scanned in a direction different from the arrangement direction of the ejection portions to make a plurality of scans for recording an image portion of an image, said apparatus comprising:

correction means for correcting an amount of the ink which is ejected onto at least one boundary of the image portion recorded in each said scan, said correction means correcting the amount of the ink ejected onto the boundary of the image portion recorded by each said scan so that the amount of the ink applied is reduced; and changing means for changing an amount of correction made by said correction means in accordance with a change in a state of the recording head used in each said scan, wherein a temperature of the ink is varied as a consequence of the change in the state of the recording head.

2. An apparatus according to claim 1, wherein said changing means changes the amount of correction made by said correction means according to a number of the ejection portions used during each said scan.

3. An apparatus according to claim 2, wherein said changing means changes the amount of correction made by said correction means so that the amount of correction is reduced when a number of the ejection portions used during each said scan is small.

4. An apparatus according to claim 1, wherein said changing means changes the amount of correction made by said correction means according to a temperature of the ink in the recording head during each said scan.

5. An apparatus according to claim 1, wherein said changing means changes the amount of correction made by said correction means according to a reduction ratio when the recording head is used in a reduction mode.

6. An apparatus according to claim 1, wherein said correction means corrects the amount of correction when an image signal supplied to at least one of the ejection portions corresponding to the boundary of the image portion has a level which is at least equal to a reference level.

7. An apparatus according to claim 6, wherein said changing means changes the amount of correction by changing the reference level.

8. An apparatus according to claim 1, wherein the recording head ejects the ink by utilizing thermal energy.

9. An apparatus according to claim 1, wherein said correction means corrects an image signal corresponding to at least one said ejection portion at at least one boundary of the array of the ejection portions used during each said scan, and said changing means changes the amount of correction of the image signal made by said correction means according to the state of the recording head during each said scan.

10. An apparatus according to claim 9, wherein said changing means changes the amount of correction of the image signal made by said correction means according to a number of said ejection portions used during each said scan.

11. An apparatus according to claim 10, wherein said changing means changes the amount of correction made by said correction means so that the amount of correction is reduced when the number of ejection portions used during each said scan is small.

12. An apparatus according to claim 9, wherein said changing means changes the amount of correction of the image signal made by said correction means according to a temperature of the ink in the recording head during each scan.

13. An apparatus according to claim 9, wherein said changing means changes the amount of correction of the image signal made by said correction means according to a reduction ratio when the recording head is used in a reduction mode.

14. An apparatus according to claim 9, wherein the recording head ejects the ink by utilizing thermal energy.

15. An apparatus according to claim 1, wherein said correction means corrects a drive signal corresponding to at least one said ejection portion at at least one boundary of the array of the ejection portions used during each said scan, and said changing means changes the amount of correction of the drive signal made by said correction means according to the state of the recording head during each said scan.

16. An apparatus according to claim 15, wherein said changing means changes the amount of correction of the drive signal made by said correction means according to a number of the ejection portions used during each said scan.

17. An apparatus according to claim 16, wherein said changing means changes the amount of correction made by said correction means so that the amount of correction is reduced when the number of ejection portions used during each said seen is small.

18. An apparatus according to claim 15, wherein said changing means changes the amount of correction of the drive signal made by said correction means according to a temperature of the ink in the recording head during each said scan.

19. An apparatus according to claim 15, wherein said changing means changes the amount of correction of the drive signal made by said correction means according to a reduction ratio when the recording head is used in a reduction mode.

20. An apparatus according to claim 15, wherein the recording head ejects the ink by utilizing thermal energy.

21. An apparatus according to claim 1, further comprising a carriage onto which the recording head is mounted.

22. An apparatus according to claim 1, further comprising transport means for transporting a recording medium onto which the image formed by the recording head is recorded.

23. An apparatus according to claim 1, wherein said recording apparatus is used in a copying machine.

24. An apparatus according to claim 1, wherein said recording apparatus is used in a facsimile machine.

25. An apparatus according to claim 1, wherein said recording apparatus is used in a terminal for a computer.

26. An ink jet recording method for recording using a recording head having a plurality of ejection portions arranged in an arrangement direction for ejecting an ink, said recording head being repeatedly scanned in a direction different from the arrangement direction of the ejection portions to make a plurality of scans for recording an image portion of an image, said method comprising the steps of:

setting a recording mode corresponding to a state of the recording head used in each said scan; and correcting an amount of the ink which is ejected onto at least one boundary of the image portion recorded in each said scan by an amount according to the recording mode that has been set, the correcting of the amount of the ink ejected onto the boundary of the image portion recorded by each said scan being such that the amount of the ink applied is reduced, wherein a temperature of the ink is varied as a consequence of a change in the recording mode.

27. A method according to claim 26, wherein, in said setting step, said recording mode is set according to a number of the ejection portions used during each said scan.

28. A method according to claim 26, wherein the amount of correction in said correcting step is reduced if the recording mode set in said setting step is such that the number of said ejection portions used is small.

29. A method according to claim 26, wherein, in said correcting step, an image signal is corrected so that the amount of the ink ejected onto the boundary of the image portion recorded by each said scan is reduced.

30. A method according to claim 26, wherein, in said correcting step, a drive signal is corrected so that the amount of the ink ejected onto the boundary of the image portion recorded by each said scan is reduced.

31. A method according to claim 29, wherein, in said setting step, said recording mode is set according to a temperature of the ink in the recording head during each said scan.

32. A method according to claim 26, wherein the recording head ejects the ink by utilizing thermal energy.

33. An ink jet recording method for producing a recording product to which an ink is attached for recording using a recording head having a plurality of ejection portions arranged in an arrangement direction for ejecting the ink, said recording head being repeatedly scanned in a direction different from the arrangement direction of the ejection portions to make a plurality of scans for recording an image portion of an image, said recording method comprising the steps of:

setting a recording mode corresponding to a state of the recording head used in each said scan; and correcting an amount of the ink which is ejected onto at least one boundary of the image portion recorded in each said scan by an amount according to the recording mode that has been set, the correcting of the amount of the ink ejected onto the boundary of the image portion recorded by each said scan being such that the amount of the ink applied is reduced, wherein a temperature of the ink is varied as a consequence of a change in the recording mode.

* * * * *

UNITED STATES PATENT AND TRADEMARK OFFICE

CERTIFICATE OF CORRECTION

PATENT NO. : 5,760,798

DATED : June 2, 1998

INVENTOR(S) : AKIO SUZUKI, ET AL.

It is certified that error appears in the above-identified patent and that said Letters Patent is hereby corrected as shown below:

COLUMN 1

Line 56, "2-26574." should read --2-265749.--.

COLUMN 12

Line 17, "seen" should read --scan--; and
Line 62, "claim 26," should read --claim 27,--.

COLUMN 13

Line 7, "claim 29," should read --claim 26,--.

Signed and Sealed this

Sixteenth Day of March, 1999

*Attest:*

*Attesting Officer*

Q. TODD DICKINSON

*Acting Commissioner of Patents and Trademarks*